US007406813B2

(12) United States Patent
Sytema et al.

(10) Patent No.: US 7,406,813 B2
(45) Date of Patent: Aug. 5, 2008

(54) DESKTOP INSERTER

(75) Inventors: Herman Sytema, Terhorne (NL); Jan Jacobus Peter Remijnse, Meppel (NL)

(73) Assignee: NEOPOST Technologies, Bagneux (FR)

( * ) Notice: Subject to any disclaimer, the term of this patent is extended or adjusted under 35 U.S.C. 154(b) by 0 days.

(21) Appl. No.: 11/321,661

(22) Filed: Dec. 29, 2005

(65) Prior Publication Data

US 2006/0163794 A1 Jul. 27, 2006

(30) Foreign Application Priority Data

Dec. 31, 2004 (NL) ..... 1027938

(51) Int. Cl.
*B65B 63/02* (2006.01)

(52) U.S. Cl. ..... 53/529; 53/381.7; 53/569; 270/58.06

(58) Field of Classification Search ..... 53/381.7, 53/569, 117, 206, 529; 270/58.06
See application file for complete search history.

(56) References Cited

U.S. PATENT DOCUMENTS 2,728,178 A 12/1955 Kern ..... 53/136
3,797,196 A * 3/1974 Harbison ..... 53/55
4,619,101 A * 10/1986 Havey et al. ..... 53/117
4,924,652 A 5/1990 Krasuski et al. ..... 53/55
4,955,186 A 9/1990 Gough ..... 53/569
5,147,275 A * 9/1992 Staniszewski ..... 493/416
5,269,744 A * 12/1993 Moll ..... 493/421
5,410,860 A * 5/1995 Coudray et al. ..... 53/569
5,514,066 A * 5/1996 Monaco ..... 493/25
5,674,348 A * 10/1997 DeFiguerido ..... 156/441.5
6,689,040 B2 * 2/2004 Ifkovits et al. ..... 493/419

FOREIGN PATENT DOCUMENTS

EP 0 781 671 B1 8/1999
EP 1 297 969 A2 4/2003

* cited by examiner

*Primary Examiner*—Thanh K. Truong
(74) *Attorney, Agent, or Firm*—Sughrue Mion, PLLC

(57) ABSTRACT

Inserter with a stuffing assembly for each time inserting a document into an envelope in the stuffing position. In the operating position, a document feeder or the exit for outputting finished mail items is situated at the front side of the housing, and the envelope holder is accessible exclusively from a rear side of the housing. The housing has at least one foot or feet for supporting the housing via the foot or feet with respect to a supporting surface on which the apparatus stands. The foot is or, respectively, feet are arranged for allowing the rotation of the housing between the operating position and a loading position while the housing rests on the supporting surface via the foot or feet, and for keeping the housing supported in said positions.

6 Claims, 1 Drawing Sheet

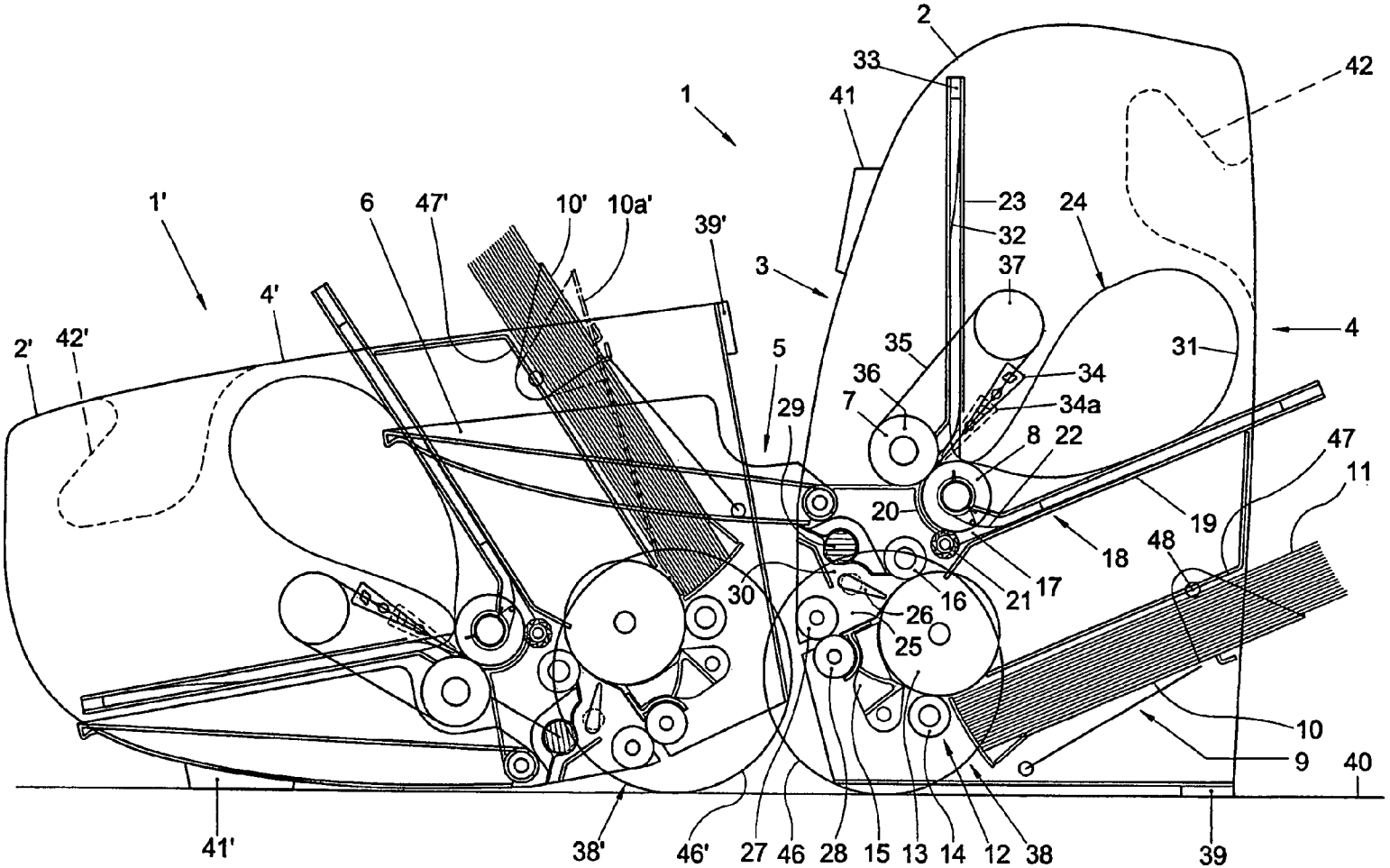
42
4
47
11
40
10
9
39
31
19
48
24
34
34a
22
18
8
17
21
23
32
37
38
12
14
2
16
26
25
13
33
35
36
7
20
15
28
41
3
5
29
46
27
1
39'
30
46'
10a'
10'
38'
47'
6
4'
41'
1'
42'
2'

DESKTOP INSERTER

CROSS-REFERENCE TO RELATED APPLICATION

This application claims priority from Dutch Patent Application No. NL 1027938, filed on Dec. 31, 2004.

FIELD AND BACKGROUND OF THE INVENTION

This invention relates to an inserter. Such apparatuses are known from practice and are typically used in mailrooms where large numbers of documents or sets of documents are each to be inserted in an envelope in order to send these documents to addressees.

However, also in small organizations that send relatively small numbers of documents, and where the documents to be sent are for a considerable part processed by hand also when being prepared prior to insertion, mechanized insertion could lead to considerable saving of labor. To be considered here are, for instance, medical practices, workshops and club administrations, as well as service companies taking care of sending smaller mailings for third parties. Accordingly, there is a need for inserters that are compact enough and simple enough to be attractive in cost price and complexity of operation for applications on a smaller scale than existing inserters.

Because of the contemplated compact structure of such inserters, there is relatively little space for the envelope hopper. In addition, a stack of envelopes, in particular in comparison with a stack of an equal number of unfolded documents, has a relatively large size. Hence, the number of envelopes that can be loaded into the envelope holder of a compact inserter is rather limited. As a consequence, the inserter will have to be loaded relatively often. Further, in the use of such compact inserters, a relatively large proportion of the documents to be processed consists of "daily mail", i.e. sets of documents that are manually assembled and per set are manually placed in the inserter. For this reason it is desirable that the inserter can be easily operated by a user seated at a workplace, for instance in that documents can be inputted from the front side and mail items come out of the machine at the front side. On the other hand, it is advantageous for a compact structure of the apparatus if the envelopes are loaded from the rear side, because the provisions for the supply of documents and the exit of mail items already occupy space at the front. Precisely with a view to compact inserters, however, loading envelopes from the rear side is disadvantageous since this needs to be done relatively often because of the relatively small capacity of the envelope holder.

SUMMARY OF THE INVENTION

It is an object of the invention to provide a solution enabling on the one hand a compact structure of an inserter, but on the other hand easy operability of the inserter by a user without him needing to leave his workplace at the inserter to reload the envelope holder.

This object is achieved according to the invention by providing an inserter comprising:

a housing having, in an operating position, a front side;

a document feeder having a document holder for taking up a document and having a dispenser for dispensing a document from the document holder;

an envelope feeder having an envelope holder for taking up a stack of envelopes and having a separator for separately dispensing individual envelopes from the envelope holder;

a stuffing assembly having an envelope holder for each time holding an envelope in a stuffing position and having at least one guide for each time guiding a document into an envelope in the stuffing position;

a document transport path between the document feeder and the stuffing position, for transporting documents from the document feeder to the stuffing position;

an envelope transport path between the envelope feeder and the stuffing position for transporting envelopes from the envelope feeder to the stuffing position;

a mail item output path connected with the stuffing position for transporting stuffed envelopes from the stuffing position; and an exit for delivering stuffed envelopes transported along the mail item output path;

wherein in the operating position at least the document feeder or the exit is situated at the front side;

wherein in the operating position the envelope holder is accessible exclusively from a rear side;

wherein the housing has at least one foot for supporting the housing via the at least one foot with respect to a supporting surface on which the apparatus stands; and wherein the at least one foot is arranged for allowing the rotation of the housing between the operating position and a loading position while it rests on the supporting surface via the foot or at least one of the feet, and for keeping the housing supported in said positions.

Owing to the machine being rotatable, while resting by its foot or feet on a supporting surface, the rear side of the machine can easily be turned towards himself by the user and it is made easy for the user to load envelopes without him needing to leave his workplace.

Embodiments of the invention are laid down in the dependent claims. Further features, effects and details of the invention will be illustrated and elucidated on the basis of an exemplary embodiment with reference to the drawing.

BRIEF DESCRIPTION OF THE DRAWING

The drawing is a cutaway side elevational view of an example of an inserter according to the invention in two positions: once in an operating position and once in a loading position.

DETAILED DESCRIPTION

In the drawing, an example of an inserter according to the invention is represented twice: on the left the inserter 1' is represented in a loading position and on the right the inserter 1 is represented in operating condition. The following description, unless specified otherwise, relates to the inserter 1 in the operating condition. Corresponding parts in the loading position are denoted by the same reference numerals but provided with a prime '.

The inserter 1 has a housing 2 with a front side 3 and a rear side 4.

On the front side 3 is a document feeder 5 with a document holder 6 for taking up a document (not shown) and with a dispenser formed by a pair of folding rollers 7, 8 for dispensing a document from the document holder 6. The document holder 6 at the same time forms a cover of the housing 2, adapted to be hinged between a closed position 6', represented in the loading position, and an open position 6, represented in the operating position.

On the rear side 4 is an envelope feeder 9 with an envelope holder 10 for taking up a stack of envelopes 11 and with a separator 12 for separately dispensing individual envelopes from the holder 10. According to this example, the separator 12 is equipped with a transport roller 13 for taking up envelopes and a separation roller 14 for each time stopping next envelopes, so that each time an envelope is dispensed off the top of the stack 11.

An envelope transport path between the envelope feeder 9 and the stuffing position serves for transporting envelopes 11 from the envelope feeder 9 to the stuffing position. The envelope transport path extends between on the one hand the transport roller 13 and on the other hand a guide 15 and a guide roller 16. The guide 15, which also serves as scraper for opening the flap of the passing envelope, and the guide roller 16 guide the envelope during operation, so that it is held against the circumferential surface of the transport roller 13, until an inlet 17 of a stuffing assembly 18 is reached.

The stuffing assembly 18 is equipped with a holder 19' for each time holding an envelope in a stuffing position and with guides 22 for each time guiding a document into an envelope in the stuffing position.

A document transport path for transporting documents from the document feeder 5 to the stuffing position extends from the document feeder 5 and has a branch passing between and through the folding rollers 7, 8 and terminating in a buckle chute 23. Laterally of the buckle chute 23 there is room for buckling a document 24 into a loop.

The folding rollers 7, 8 extend throughout the width of the document transport path, so that they can form a fold extending throughout the width of the document 24.

A first section 31 of the document 24, measured from a folding nip between the folding rollers 7, 8 along the document 24, is located closer to the folding nip than is a second section 32. For causing the first section 31 of the document 24 to buckle into a loop, the folding rollers 7, 8 are drivable in an input rotation sense, and an arrester is provided in the form of a stop 33 in the buckle chute 23 for arresting a portion of the document 24 downstream of the folding rollers 7, 8 with respect to the portions of the document 24 transported between the folding rollers 7, 8.

Means for bending the second section 32 of the document 24 to the folding nip are formed, according to this example, by a folding blade 34 which is reciprocable between the positions designated with reference numerals 34 and 34*a*. To this end, the folding blade 34 is attached to a pair of toothed belts 35 which pass around rollers 36, 37 and which are coupled with the drive of the folding rollers 7, 8 via a clutch (not shown).

The folding rollers 7, 8 are further drivable in an output rotation sense, such that the second section 32 of the document 24 is transported into the folding nip.

In operation, the folding of a document 24 in the apparatus shown starts with introducing the document 24 into the folding nip between the folding rollers 7, 8. Next, to cause the first section 31 of the document 24 to buckle into a loop, the folding rollers 7, 8 are rotated further in the input rotation sense, whereby portions of the document 24 situated between the folding rollers 7, 8 are transported further. Relative to the portions of the document 24 transported between the folding rollers 7, 8, the portion 32 of the document 24 downstream of the folding rollers 7, 8 is arrested in that it butts against the stop 33 in the buckle chute 23.

Rotating the folding rollers 7, 8 is then continued, until the operative condition represented in the drawing has been reached, in which a trailing end portion of the document 24 is just retained between the folding rollers 7, 8.

Next, the second section 32 of the document 24 is urged to the folding nip, in that the folding blade 34, on a side of the document 24 remote from the folding nip, is moved towards the folding nip, into the position designated with reference numeral 34*a*.

The folding rollers 7, 8 are thereupon rotated in an output rotation sense, whereby the sections of the folding rollers 7, 8 in the area of the folding nip transport the second section 32 into the folding nip and a first fold is formed.

Next, the folding rollers 7, 8 rotate further, so that also the first section 31 of the document 24 is transported through the folding nip and a second fold, spaced from the first fold, is formed in that the loop is folded flat.

When the document 24 has been outputted, the folding blade 34 is moved back to its initial position. This can for instance be done during the input of a next document 24 to be folded.

Further, the document transport path proceeds between a lower one of the folding rollers 8 and guides 20, 21 in the form of a plate 20 and a roller 21 to the stuffing position, for transporting folded documents to the stuffing position.

A mail item output path 25 is connected with the stuffing position for transporting stuffed envelopes from the stuffing position and extends between the transport roller 13 and the guide roller 16, along a switch valve 26 for closing the flap and between a pair of output rollers 27, 28. The output rollers 27, 28 also form an exit for delivering stuffed envelopes, transported along the mail item output path 25. Along a side of the switch valve remote from the mail item output path 25, extends a ranch 30 for guiding the flap of the envelope to a moistener 29. The switch valve 26 is arranged, each time upon the further transport of an envelope, after the flap thereof has been moistened by the moistener 30, to pivot along with the envelope from the position shown to a position directed more towards the output rollers 27, 28. The flap of the envelope is thereby closed. The output rollers 27, 28 also serve for pressing on the closed flap of the envelope.

That the document feeder 5 and the exit 27, 28 are situated at the front of the housing 2 provides the advantage that these are easily operable for a user operating the inserter 1 from a workplace. The document feeder 5 in which the user must each time place documents to be inserted is moreover well accessible because it is situated above the exit 27, 28.

That the envelope holder 10 is accessible exclusively from a rear side of the housing then provides the advantage that it does not occupy any space at the front, thus enabling a compact structure.

The housing 2 has feet 38, 39, 41 for supporting the housing 2 via these feet 38, 39, 41 on a supporting surface 40 on which the apparatus stands. According to this example, the feet 38, 39, 41 are positioned in pairs and of each pair of feet 38, 39, 41 one is visible in the side elevational view. The feet 38, 39, 41 are arranged for allowing rotation of the housing 2 between the operating position and the loading position (indicated with reference numeral 2') while it rests via a set 38 of those feet 38, 39, 41 on the supporting surface 40, and for keeping the housing 2 supported in the two positions. The apparatus 1 in the operating position then rests by the feet 38, 39 on the supporting surface 40, while a set 41 of the feet are situated at the front of the housing 2. In the loading position, the apparatus rests by the feet 38', 41' on the supporting surface 40, while a set 39 of the feet are situated on a rear side of the housing 2'.

In the loading position, the original rear side 4' of the housing 2' faces up, so that the envelope holder 10', which is accessible exclusively from the side 4, 4' of the housing 2, 2' that faces rearwards in the operating condition, is readily accessible to the user without him needing to leave his workplace. Since during rotation from the operating position to the loading position the housing 2, 2' continues to rest on the supporting surface 40 via at least a number of the feet 38, 39, 41, 38', 39', 41', rotation can be simply carried out in a controlled manner by a user without the apparatus needing to be lifted.

To further facilitate the housing 2, 2' being moved back and forth between the two positions mentioned, the housing 2, 2' adjacent its upper end is provided with a grip 42, 42'. In the condition of use, this grip 42, 42' is situated at the rear side and in the loading condition at the upper side of the housing 2, 2', so that it can easily be held while changing the position of the housing without needing to be regripped.

The rotation of the housing in order to make the envelope holder operatively situated at the rear side more easily accessible for reloading can be designed, within the framework of the invention, to take place about a randomly oriented axis or about several, equally or unequally oriented, axes. Thus, for instance, the housing could be provided with a foot with a bearing allowing the housing to rotate relative to the foot about a vertically oriented axis, while the housing continues to rest on the supporting surface via the foot.

However, it is preferred that, as with the apparatus according to the example shown in the drawing, the feet are (or the foot is) arranged to allow the rotation of the housing 2, 2' from the operating position to the loading position about at least a horizontal axis, such that, in the loading position, the side 4' of the housing 2' facing rearwards in the operating position faces up, and that the housing 2, 2' in the operating position has feet 38, 38', 41, 41' at the front side 3 of the housing 2 for supporting the apparatus in the loading position. This makes it possible to realize the rotatability between the operative conditions without bearing provisions between the foot or feet and the housing and provides the advantage that the housing 2, 2' upon rotation from the operating position to the loading position, tilts towards the user, which further simplifies the loading of envelopes into the envelope holder 10. In the operating position, being most common in use, the housing 2 is then tilted away from the user again, so that the supporting surface 40 adjacent the user is free for use as working surface again.

The feet 38, 38' each have a rolling surface 46, 46' capable of rolling upon tilting of the apparatus between the operating position and the loading position. This enables tilting with a flowing movement and continuous support by the supporting surface 40. The feet 38, 38' have a rolling surface 46, 46' which, considered in the operating position, continues from a portion facing away from the underside of the housing 2 and which is situated at the underside of the housing 2, into a portion that is facing away from the front side of the housing 2, at the front side of the housing 2. Consequently, these are compact in design.

Considered in the operating position of the housing 2, the envelope holder 10 is situated in spaced relation under an upper side 47 of an inlet of the envelope feeder 9. The envelope holder 10 is movable between an open position 10*a*' (in the loading position represented with chain-dotted lines) in which it is situated in the area of the inlet of the envelope feeder 9 at a maximum distance from the upper side 47', and a further position 10 (represented in full lines both in the operating position and in the loading position), in which it is situated, at least in the area of the inlet, at a smaller distance from the upper side 47 than in the open position 10*a*'. The envelope holder 10 is then suspended so as, upon tilting of the housing 2 to the loading position, to independently assume the open position 10*a*'. As a result, the inlet of the envelope feeder 9 opens independently upon the housing 2 tilting to the loading position. This facilitates placing a stack of envelopes in the envelope feeder 9.

In the apparatus according to this example, the possibility to open the inlet of the envelope feeder 9 has been achieved in that the envelope holder 10 is pivotable about a hinge 48 which is situated at a smaller distance from the front side of the apparatus than the upper side 47 of the inlet of the envelope feeder. Opening, upon tilting to the loading position, then proceeds independently, in that the center of gravity of the envelope holder 10, 10', when the apparatus is in the loading position, is situated behind the hinge 48. When the apparatus is tilted headfirst, the empty envelope holder 10 thereby tilts against the sense of tilt, so that the inlet of the envelope feeder 9 opens further.

The invention claimed is:

1. An inserter comprising:

a housing rotatable between an operating position and an envelope loading position, the housing having a front side facing forwardly when the housing is in the operating position and a rear side facing rearwardly when the housing is in the operating position;

a document feeder having a document holder for taking up a document and having a dispenser for dispensing a document from the document holder;

an envelope feeder having an envelope holder for taking up a stack of envelopes and having a separator for separately dispensing individual envelopes from the envelope holder, wherein the envelope holder is situated in the rear side of the housing for loading envelopes therein through the rear side of the housing;

a stuffing assembly having an envelope holder for each time holding an envelope in a stuffing position and having at least one guide for each time guiding a document into an envelope in the stuffing position;

a document transport path between the document feeder and the stuffing position, for transporting documents from the document feeder to the stuffing position;

an envelope transport path between the envelope feeder and the stuffing position for transporting envelopes from the envelope feeder to the stuffing position;

a mail item output path connected with the stuffing position for transporting stuffed envelopes from the stuffing position; and an exit for dispensing stuffed envelopes transported along the mail item output path;

wherein, when the housing is in the operating position, at least the document feeder or the exit is situated at the front side of the housing;

wherein the housing has at least one first foot for supporting the housing with respect to a supporting surface on which the apparatus stands;

wherein the at least one first foot is arranged for allowing the rotation of the housing between the operating position and the envelope loading position while the housing is supported on the supporting surface via the at least one first foot in both of said positions;

wherein the at least one first foot is arranged for allowing the rotation from the operating position to the envelope loading position about a horizontal axis, such that, in the envelope loading position, the rear side of the housing faces up relative to the supporting surface, and wherein the housing is constructed with at least one second foot spaced from the at least one first foot at the front side of the housing for supporting the housing in the envelope loading position.

2. An inserter according to claim 1, wherein in the operating position the document feeder and the exit are situated at the front side of the housing and wherein the document feeder is situated above the exit.

3. An inserter according to claim 1, wherein in the envelope feeder has an inlet between an upper inlet boundary and the envelope holder, and wherein the envelope holder is pivotable about a hinge axis between an open position at a maximum distance from the upper inlet boundary and a further position at a minimum distance from the upper inlet boundary, and wherein the envelope holder is suspended for independently assuming the open position upon tilting of the housing to the envelope loading position.

4. An inserter according to claim 3, wherein the hinge axis which is situated at a smaller distance from the front side of the housing than said upper inlet boundary.

5. An inserter according to claim 4, wherein in the envelope loading position the envelope holder has a center of gravity which is situated rearwardly of said hinge axis.

6. An inserter comprising:

a housing rotatable between an operating position and an envelope loading position, the housing having a front side facing forwardly when the housing is in the operating position and a rear side facing rearwardly when the housing is in the operating position;

a document feeder having a document holder for taking up a document and having a dispenser for dispensing a document from the document holder;

an envelope feeder having an envelope holder for taking up a stack of envelopes and having a separator for separately dispensing individual envelopes from the envelope holder, wherein the envelope holder is situated in the rear side of the housing for loading envelopes therein through the rear side of the housing;

a stuffing assembly having an envelope holder for each time holding an envelope in a stuffing position and having at least one guide for each time guiding a document into an envelope in the stuffing position;

a document transport path between the document feeder and the stuffing position, for transporting documents from the document feeder to the stuffing position;

an envelope transport path between the envelope feeder and the stuffing position for transporting envelopes from the envelope feeder to the stuffing position;

a mail item output path connected with the stuffing position for transporting stuffed envelopes from the stuffing position; and an exit for dispensing stuffed envelopes transported along the mail item output path;

wherein, when the housing is in the operating position, at least the document feeder or the exit is situated at the front side of the housing;

wherein the housing has at least one first foot for supporting the housing with respect to a supporting surface on which the apparatus stands;

wherein the at least one first foot is arranged for allowing the rotation of the housing between the operating position and the envelope loading position while the housing is supported on the supporting surface via the at least one first foot in both of said positions;

wherein the envelope feeder has an inlet between an upper inlet boundary and the envelope holder, and wherein the envelope holder is pivotable about a hinge axis between an open position at a maximum distance from the upper inlet boundary and a further position at a minimum distance from the upper inlet boundary, and wherein the envelope holder is suspended for independently assuming the open position upon tilting of the housing to the envelope loading position;

wherein the hinge axis which is situated at a smaller distance from the front side of the housing than said upper inlet boundary; and wherein in the envelope loading position the envelope holder has a center of gravity which is situated rearwardly of said hinge axis.

* * * * *